US007958679B2

(12) United States Patent
Gosling et al.

(10) Patent No.: US 7,958,679 B2
(45) Date of Patent: Jun. 14, 2011

(54) VARIABLE CONNECTORS FOR ANGLING MODULAR WALL SYSTEMS

(75) Inventors: Geoff Gosling, Calgary (CA); Mogens Smed, De Winton (CA)

(73) Assignee: DIRTT Environmental Solutions, Ltd., Calgary (CA)

( * ) Notice: Subject to any disclaimer, the term of this patent is extended or adjusted under 35 U.S.C. 154(b) by 868 days.

(21) Appl. No.: 11/854,524

(22) Filed: Sep. 12, 2007

(65) Prior Publication Data

US 2008/0069632 A1 Mar. 20, 2008

Related U.S. Application Data

(60) Provisional application No. 60/826,051, filed on Sep. 18, 2006, provisional application No. 60/826,044, filed on Sep. 18, 2006, provisional application No. 60/826,055, filed on Sep. 18, 2006.

(51) Int. Cl.
*E04B 1/346* (2006.01)

(52) U.S. Cl. ..... 52/65; 52/36.1; 52/396.04

(58) Field of Classification Search ..... 52/282.1, 52/36.1, 64, 65, 70, 235, 239, 396.04, 579, 52/582.1

See application file for complete search history.

(56) References Cited

U.S. PATENT DOCUMENTS

| | | | | | |
|---|---|---|---|---|---|
| 2,210,652 | A * | 8/1940 | Dennett | 160/231.1 |
| 3,875,721 | A * | 4/1975 | Mengeringhausen et al. | 52/846 |
| 4,535,577 | A * | 8/1985 | Tenser et al. | 174/495 |
| 4,601,145 | A * | 7/1986 | Wilcox | 52/238.1 |
| 4,947,601 | A * | 8/1990 | McGuire | 52/239 |
| 5,065,559 | A * | 11/1991 | Zegel et al. | 52/239 |
| 5,105,594 | A * | 4/1992 | Kirchner | 52/239 |
| 5,133,108 | A * | 7/1992 | Esnault | 16/225 |
| 5,339,576 | A * | 8/1994 | Fussler | 52/71 |
| 5,502,930 | A * | 4/1996 | Burkette et al. | 52/71 |
| 5,570,971 | A * | 11/1996 | Rixen et al. | 403/381 |
| 6,571,519 | B1 * | 6/2003 | Diffrient et al. | 52/239 |
| 2004/0237416 | A1 * | 12/2004 | Pitsch et al. | 52/36.1 |

* cited by examiner

*Primary Examiner* — Basil Katcheves
*Assistant Examiner* — Branon C Painter
(74) *Attorney, Agent, or Firm* — Workman Nydegger

(57) ABSTRACT

A system for connecting wall modules in a variable and a flexible fashion includes a flexible angle connector and a flexible spacing connector. The flexible angle connector and the flexible spacing connector can be used together at the same wall module joint as part of joints means. The flexible connectors provide the ability to angle wall modules at virtually any angle or degree of curvature. In addition, the flexible connectors can be configured to block light, air and sound. The flexible connectors can be used to provide a virtually endless wall/angle alignment in a given interior or exterior space.

19 Claims, 4 Drawing Sheets

VARIABLE CONNECTORS FOR ANGLING MODULAR WALL SYSTEMS

CROSS-REFERENCE TO RELATED APPLICATIONS

The present invention claims the benefit of priority to U.S. Provisional Patent Application No. 60/826,051, filed on Sep. 18, 2006, entitled "Variable Connection System for Modular Wall Systems," the entire contents of which are incorporated herein by reference.

BACKGROUND OF THE INVENTION

1. The Field of the Invention

Implementations of the present invention relate generally to systems, methods, apparatus used to connect adjacent wall modules together, such as wall modules used in space partitioning.

2. Background and Relevant Art

Office space can be relatively expensive, not only due to the basic costs of the location and size of the office space, but also due to any construction needed to configure the office space in a particular way. For example, an organization might purchase or rent a large open space in an office complex, and then subdivide or partition the open space into various offices or conference rooms depending on the organization's needs and size constraints. Some organizations will prefer to build permanent walls and structures to partition the space, which can be prohibitively expensive and time consuming. Accordingly, other organizations will partition the space with modular assemblies that can be easily assembled and reconfigured as desired. Specifically, modular systems tend to be relatively inexpensive compared with the time, effort, and materials to build out a space and/or to reconfigure previously constructed walls as the organization's needs change.

For example, modular office partitions typically include a series of individual wall modules (or panels) that can be immediately placed into a particular partition position to create at least an outline of a cubicle, office, or conference room. That is, a manufacturer or assembler can typically take a given set of wall modules, and align the wall modules along a floor pattern until the desired configuration is achieved. The manufacturer can then secure the given wall modules in position. The assembled partitions can either free-standing, or can be rigidly attached to the permanent support structures. A "finished" look is generally completed by adding trim pieces in the joints between panels or wall modules.

Of course, it is typically the case that what modular systems provide in terms of easy assembly and re-configurability the modular systems also give up in terms of creative flexibility. For example, typical modular systems are designed to connect together with only 0° or 90° angles between adjacent wall modules. If the organization desires any deviation from this, such as unconventional angles or even curvatures, the manufacturer or assembler will typically need to create custom connectors, or will otherwise need to improvise a solution with custom-shaped wall modules. Manufacturing custom connectors or wall modules, however, can be costly and time consuming. In addition, improvised solutions often fail to, for example, provide adequate sound protection and/or privacy between adjacent spaces and/or the desired aesthetics. Furthermore, customizing such systems can add significant costs, and otherwise defeat one of the main advantages of modular systems.

Accordingly, there are a number of difficulties associated with dividing interior office space with modular systems. In particular, there are a number of difficulties present in terms of efficiently connecting adjacent panels and/or custom posts to accommodate custom curves or angling.

BRIEF SUMMARY OF THE INVENTION

Implementations of the present invention overcome one or more problems in the art with systems, methods, and apparatus configured to provide flexibility for partitioning an interior space with modular systems. In particular, implementations of the present invention provide flexibility with regard to angles and spacing between adjacent wall modules. In addition, implementations of the present invention provide such flexibility without the time consuming and costly practice of producing project-specific components for each design solution. Implementations of the present invention can also provide light and sound barriers between wall modules despite continuously variable angles and spacing between wall modules.

For example, a flexible joint means in accordance with an implementation of the present invention for stably joining modular walls at plurality of arbitrary angles can include at least a first wall module and an opposed second wall module. The flexible joint means can also include a connector interface attached to an edge of first wall module and an opposing connector interface attached to the opposed second wall module. In addition, the flexible joint means can include at least a first and second flexible connector. In this example, each of the first and second flexible connectors reversibly attach to both of the opposed connector interfaces. Furthermore, the first wall module and the opposed second wall module are movable with respect to each other about the first and second flexible connectors.

In addition, a system in accordance with an implementation of the present invention for partitioning an interior or exterior space can include a plurality of modular walls to be joined together as one or more partitions. The plurality of modular walls each having at least one edge to be joined with an edge of another of the plurality of modular walls. The system can also include a plurality of flexible joint means for flexibly joining the edges between the plurality of modular walls. To this end, each of the flexible joint means can be configured in size and shape to seal the edges between the plurality of modular walls to be joined, and orient at least two of the modular walls at substantially non-planar angles.

Furthermore, a method in accordance with an implementation of the present invention of partitioning an interior or exterior space with adjacent modular components at both planar and non-planar angles can include arranging a plurality of wall modules in an interior or exterior space, where at least two of the plurality of wall modules are to be connected together at an angle. The method can also include connecting two connector interfaces of the two wall modules together on at least one side with a first flexible connector, and connecting the two connector interfaces on an opposing side with a second flexible connector. In addition, the method can include positioning one of the two wall modules with respect to the other of the two wall modules so that the two wall modules form a non-planar angle.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1A:
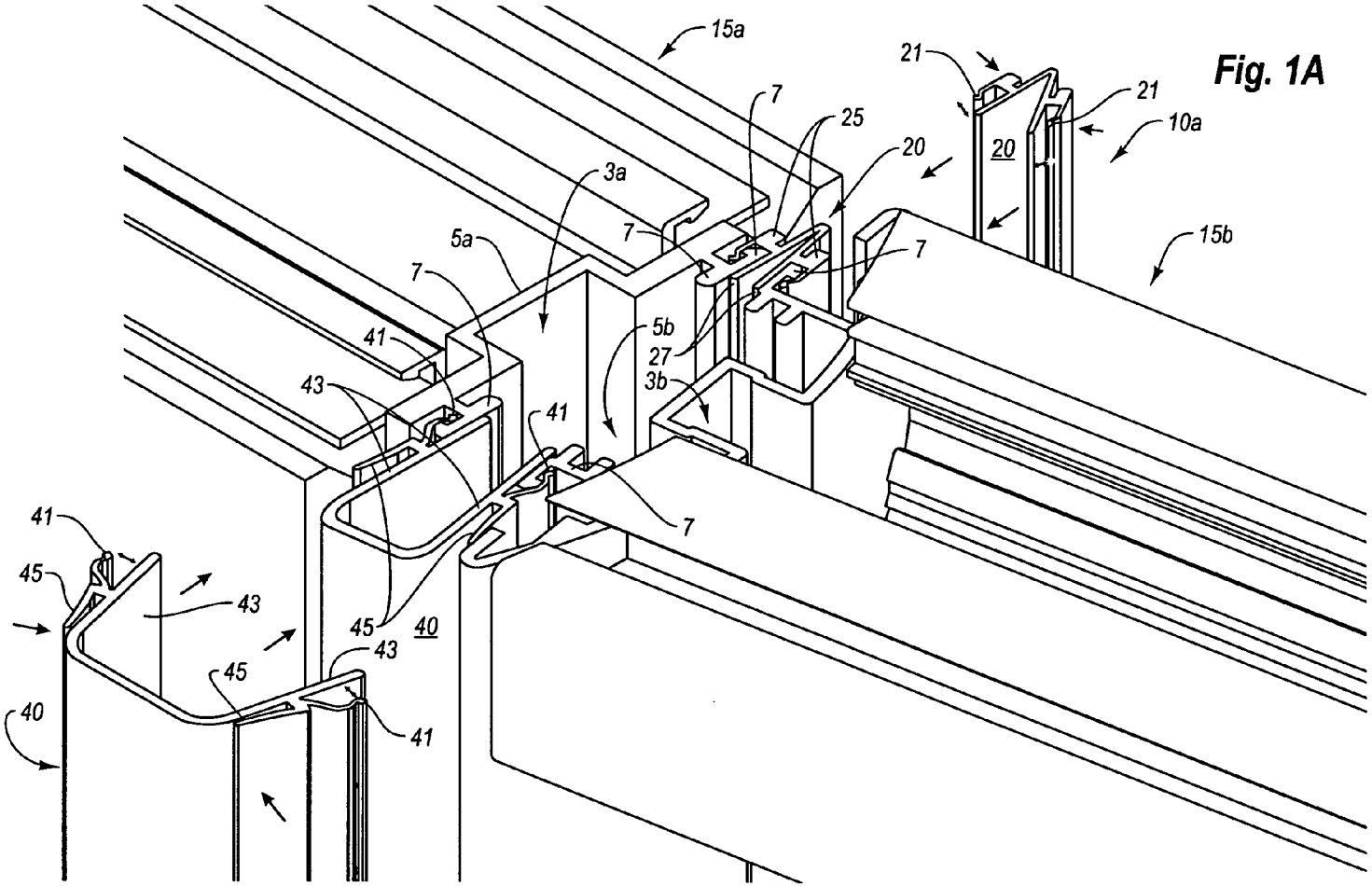
FIG. 1A illustrates a joint between two wall modules using a flexible spacing connector and a flexible angle connector in accordance with an implementation of the present invention.

The present invention extends to systems, methods, and apparatus configured to provide flexibility for partitioning an interior space with modular systems. In particular, implementations of the present invention provide flexibility with regard to angles and spacing between adjacent wall modules. In addition, implementations of the present invention provide such flexibility without the time consuming and costly practice of producing project-specific components for each design solution. Implementations of the present invention can also provide light and sound barriers between wall modules despite continuously variable angles and spacing between wall modules.

In general, and as will be understood more fully herein, implementations of the present invention accomplish these and other advantages using a variable flexible joint means to connect at least two wall modules together at virtually any angle. In at least one implementation, the variable flexible joint means comprises (i) at least two wall modules (e.g., 15*a-b*), and (ii) at least one flexible spacing connector (e.g., 40). In addition, the variable flexible joint means can comprise (iii) a flexible angle connector (e.g., 20). Both the flexible spacing connector and the flexible angle connector are referred to herein as "flexible connectors."

In general, both of the flexible connectors (i.e., the flexible spacing connector and flexible angle connector) can comprise material of sufficient flexibility and/or rigidity to allow appropriate separations between wall modules (and to expand across the outside angle of a mitered condition). For example, the flexible spacing connector (e.g., 40) can comprise any number of naturally occurring or synthetic materials that can be configured with rigid connection details, such as any number of flexible rubber, plastic, or even metallic materials, or combinations thereof. In addition, the flexible spacing connector can be configured of sufficient materials to firmly attach wall modules together, while, at the same time, allowing continuously flexible, variable distance and angle between wall modules.

As with the flexible spacing connector, the flexible angle connector can also comprise any number or type of naturally occurring or synthetic materials, such as any number or type of flexible rubber, plastic, or even metallic materials, or combinations thereof. In addition, one will appreciate that the specific type of material used for both the flexible spacing connector and for the flexible angle connector can be chosen for specific aesthetic properties, as well as for connecting/bending properties. The material can also be chosen for sound or light-blocking properties (i.e., to form a "seal"). Along these lines, the flexible spacing connector and/or flexible angle connector can further be configured with any dimensional properties such as to cover an entire edge length of a given wall module 15*a-b*, as well as to cover any larger or smaller length, as desired.

In general, the flexible angle connector is configured with rigid connection details to maintain a firm connection about a single pivot point at an inside angle between two wall modules. This contrasts with the flexible spacing connector, which is generally configured to provide spacing that accommodates pivoting about the flexible angle connector, or otherwise generates an angle that is generally complementary to that provided by the flexible angle connector. Accordingly, and as will be understood more fully herein, the flexible spacing connector and flexible angle connector of the variable flexible joint means can produce a single pivot point, which can be used for predictable layout designs of virtually any angle or degree of curvature.

Referring now to the Figures, FIG. 1A illustrates a joint and corresponding flexible joint means 10*a* between two wall modules 15*a-b*. As a preliminary matter, wall modules 15*a* and 15*b* comprise any number, style, or composition of materials, including any number or type of naturally or synthetically occurring wood, metallic, plastic, or rubber materials, or composites thereof that can be used to partition a given space. In addition, FIG. 1A shows that a manufacturer joins these two wall modules 15*a-b* via flexible joint means 10*a* at least in part using a substantially u-shaped flexible spacing connector 40 and substantially v-shaped flexible angle connector 20. FIG. 1A also shows that the variable flexible joint means 10*a* involve use of opposing connection interfaces 5*a* and 5*b*.

As shown, FIG. 1A shows that each connection interface 5(*a-b*) comprises a set of opposing rails 7 on opposing sides thereof. For example, FIG. 1A shows that connector interface 5*a* comprises two sets of opposing rails 7, while connector interface 5*b* also comprises two sets of opposing rails 7. The rails on one connector interface (e.g., 5*a*) are configured to align and match up with rails on an opposing connector interface (e.g., 5*b*). Thus, and as understood more fully below, the rails 7 for each connector interface 5 can serve as connection points for any or both of the flexible spacing connector 40 and the flexible angle connector 20 members.

In addition, FIG. 1A illustrates that connection interface 5*a* (used with wall module 15*a*) is somewhat different in shape compared with the connection interface 5*b* (used with wall module 15*b*). For example, FIG. 1A shows that connection interface 5*a* comprises a female gap 3*a*, which is reciprocal with a male extension 3*b* on connection interface 5*b*. In this case the reciprocal male extension 3*b* is essentially "male" with respect to gap 3*a* on one side, but, on an opposing side, further comprises a concave or female connection space.

As explained more fully herein, this difference in shaping between connector interfaces 5 can provide various functional benefits in terms of the type of wall module 15. For example, connector interface 5*a* is of a shape more typical of solid type walls, whereby a finishing material is applied to the outside surfaces of the wall. By contrast, connector interface 5*b* is more typical of a glass type wall, or where a center mounted substrate finish material would be positioned in the channel of male extension 3*b*. This difference in shaping between the connection interfaces 5*a* and 5*b*, however, is not necessarily required. In particular, both of wall modules 15*a* and 15*b* can be attached to the same opposing connector interfaces (5*a* or 5*b*), rather than the alternating forms as illustrated.

In any event, FIG. 1A shows that a manufacturer has connected flexible spacing connector 40 to one set of rails 7 on connection interfaces 5*a* and 5*b*, while having connected flexible angle connector 20 to the opposing sets of rails 7 thereof. FIG. 1A also shows that the flexible spacing connector 40 and flexible angle connector 20 are somewhat similar in configuration, thereby enabling a similar connection or attachment procedure. For example, FIG. 1A shows that flexible spacing connector 40 comprises a set of flexible flanges 45 that are connected to a set of flexible, opposed walls 43.

Thus, to connect flexible spacing connector 40 to rails 7 of opposing connector interfaces 5*a* and 5*b*, the manufacturer can squeeze or otherwise press flanges 45 together so that the outermost gripping elements 41 spread apart from the opposing walls 43. This increased spacing can provide an easier fit about the exposed, outside ends of rails 7. The manufacturer can then position or otherwise press the flexible spacing connector 40 into position against the opposing connector interfaces 5*a*, thereby at least partially securing one side of the opposed connector interfaces 5*a* and 5*b* (and hence wall modules 15*a* and 15*b*) together.

The manufacturer can perform a similar sequence of actions on the opposing side of the two wall modules 15*a* and 15*b* using flexible angle connector 20. For example, FIG. 1A shows that the manufacturer can also squeeze or otherwise press the variable angler connector 20 at flanges 25, thereby creating a greater gap between gripping elements 21 and the opposing walls 27. Again, this increase in the gap space allows the manufacturer to more easily press or otherwise mount the flexible angle connector 20 to the exposed, outside ends of rails 7 on both of connector interfaces 5*a* and 5*b*. One will appreciate that securing the opposing side of the opposed connector interfaces 5*a* and 5*b* (and hence wall modules 15*a* and 15*b*) completes the assembly of at least one implementation of the variable angle flexible joint means 10(*a*).

In any event, and once connected, the manufacturer can then bend, twist, or otherwise position the two wall modules 15*a*-15*b* with respect to each other to create virtually any desired degree of angle or curvature within the expansion capabilities of the flexible spacing connector 40. That is, the manufacturer can align the wall modules 15*a*-15*b* along a substantially planar conformation (e.g., 0° or 180°), as well as conventional right angle formations (e.g., 90°). In the alternative, at least one advantage of the present invention is that the manufacturer can align or position the two wall modules 15*a*-15*b* along substantially "non-planar" or "non-right angle" alignments, such as any angle between 0° and 90°, or between 90° and 180°. As understood herein, continuing a sequence of such alignments (through appropriate positioning of wall modules) can provide the appearance of curved partitions or walls. Generally, the manufacturer is limited in angle alignment only to the given flexibility of the given flexible connector materials.

Figure 1B:
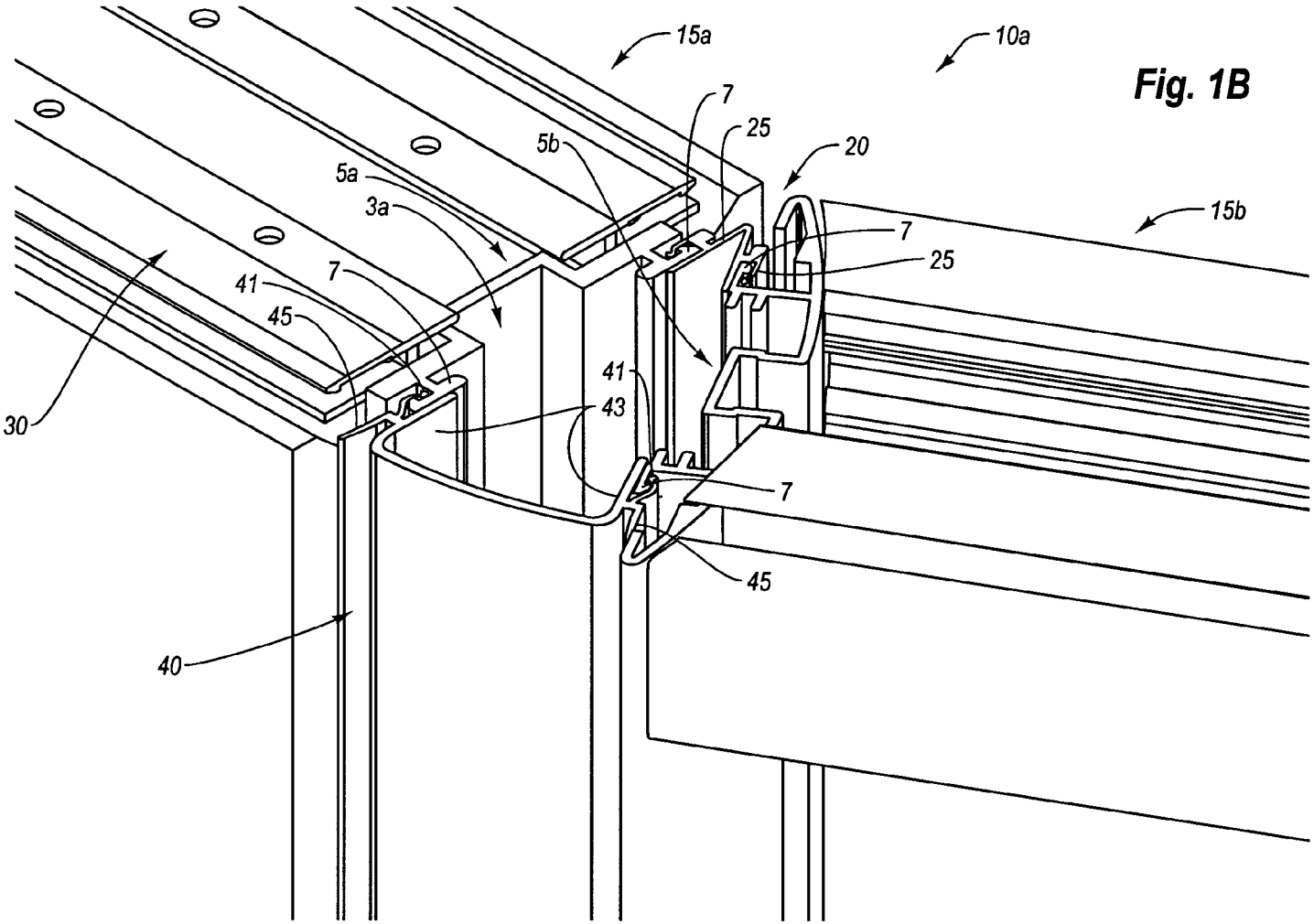
FIG. 1B illustrates the joint of FIG. 1A after the angle between the two wall modules has been changed.

Accordingly, the manufacturer can bend, position, or otherwise align the two wall modules 15*a*-*b* in a manner that accommodates the bend or flex properties of the flexible spacing connector 40 and the flexible angle connector 20. This will typically mean that the flexible angle connector 20 will serve as something of a pivot point so that the flexible angle connector 20 compresses as the two wall modules 15*a*-*b* bend toward each other. By contrast, the flexible spacing connector 40 will complementarily stretch or flex as necessary to accommodate bending about the pivot point provided by flexible angle connector 20, or to accommodate the two wall modules 15*a*-*b* bending away from each other on that opposing side. For example, FIG. 1B shows that flexible angle connector 20 is compressed somewhat, while the flexible spacing connector 40 is expanded somewhat to accommodate an angle between wall modules 15*a* and 15*b*.

One will appreciate that, at least in part since the flexible connectors continue to span the joint between the two wall modules, both flexible connectors can not only maintain a strong attachment interface, but also seal out light, air, and sound, both before and after angling of the two wall modules 15*a*-*b*. This can enhance not only the sturdiness of the assembly, but also the potential privacy effects intended by the wall modules 15*a*-*b*, regardless of alignment. Along these lines, one will appreciate that the shape and coloration of the flexible spacing connector 40 and flexible angle connector 20 can be varied widely for any number of similar functional and/or aesthetic properties as part of the joint means 10.

Figure 2:
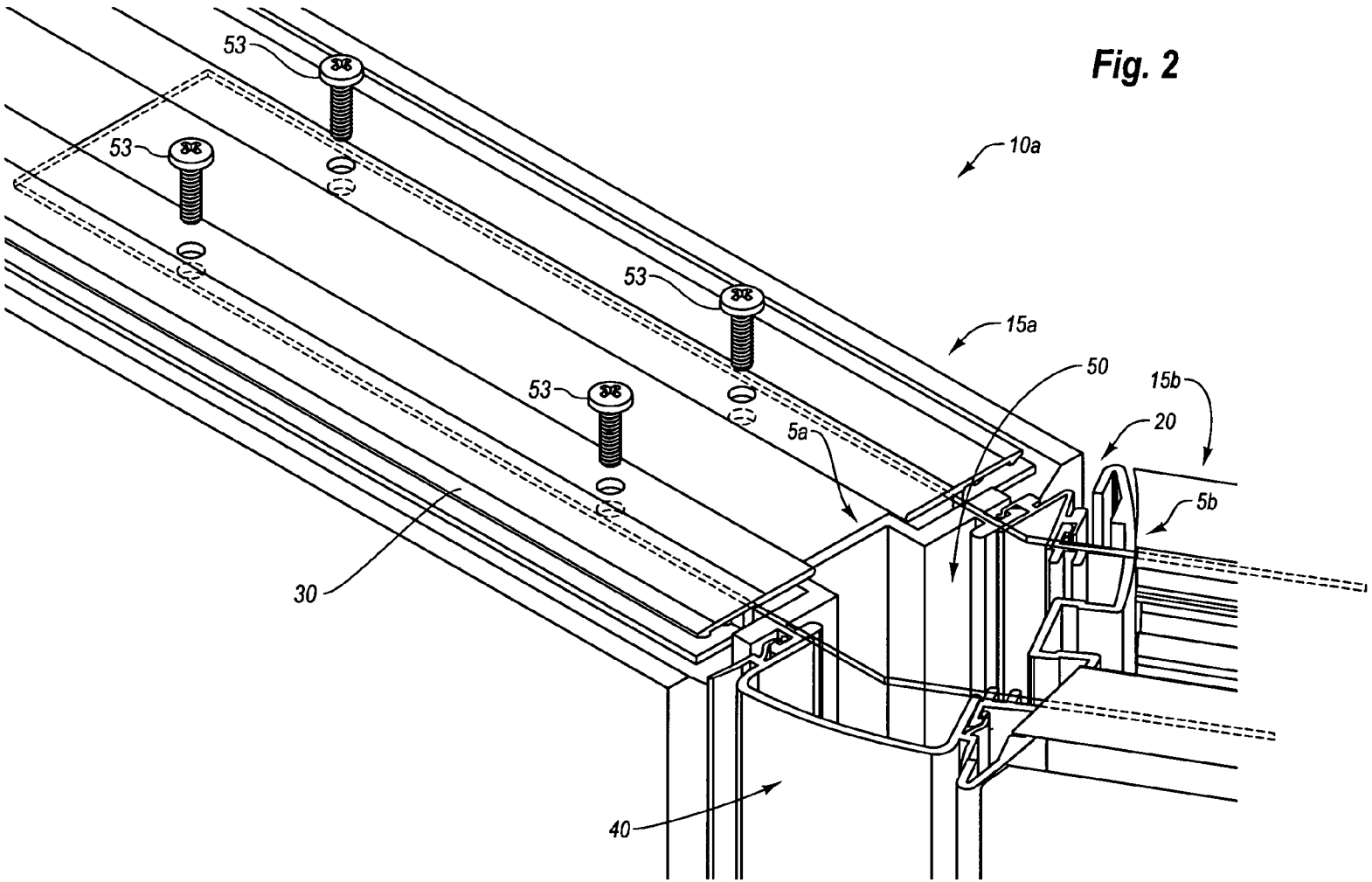
FIG. 2 illustrates the joint of FIGS. 1A-1B that further incorporates a rigid connector in accordance with an implementation of the present invention for holding a particular angle between the two wall modules.

In any event, and despite this flexibility of flexible joint means 10 materials/components, one will appreciate that it may nevertheless be desirable to secure the angled conformation between two different wall modules, particularly for free-standing wall modules. For example, FIG. 2 shows that a manufacturer can add a rigid angle connector 50 to flexible joint means 10*a*. In general, the rigid angle connector 50 can be configured with virtually any material including any sufficiently rigid rubber, plastic, wood, or metallic materials (or combinations thereof). These materials are generally chosen so that rigid angle connector 50 can hold virtually any size, shape, or degree of angle between 0° and 180° between two wall modules 15*a*-*b*. Of course, these materials can also be chosen for any number of optical or aesthetic concerns, including translucence or transparence.

For example, FIG. 2 shows that a manufacturer has bent the two wall modules 15*a*-*b* with respect to each other to form an obtuse angle. The manufacturer can then position the rigid angle connector 50 on a surface (e.g., the upper surface) of the two wall modules 15*a*-*b* in order to hold the angle. Along these lines, in at least one implementation, the manufacturer also attaches an upper connector interface plate to at least one of the upper surfaces of the wall modules. For example, FIG. 2 shows that the manufacturer has attached a perforated connector interface plate 30 on top of wall module 15*a*. The manufacturer can thus slide the rigid angle connector 50 through channels in the upper connector interface plate 30 until various perforations in the connector interface plate and the rigid angle connector 50 are aligned. The manufacturer can perform a similar alignment for wall module 15*b*.

Once in alignment, the manufacturer can fasten the rigid angle connector in place. For example, FIG. 2 shows that the manufacturer can secure the rigid connector 50 to the two wall modules 15 using any number or type of fasteners 53. Accordingly, rigid connector 50 (and the corresponding upper connector interface plates) will maintain the desired angle between wall modules 15*a*-*b* as long as necessary. That is, the rigid connector plate 50 can maintain the angle despite any other reflex stresses from the connectors 20 and 40, and/or until the manufacturer desires to realign the wall modules 15*a*-*b* with a new angle.

Accordingly, one will appreciate that the above-described components can be used to create a very wide range of partition configurations, including a wide range of angles and floor layout designs. For example, the manufacturer can set up a series of wall modules (15*a*, 15*b*, etc.) with flexible spacing and flexible angle connectors, and with corresponding rigid connectors, to form virtually any number of possible geometric configurations. To reconfigure the space, the manufacture need only unfasten each rigid angle connector 50 and flex or otherwise move each set of wall modules 15*a-b* into a new space. In some cases, the manufacturer may even need to strip out and replace flexible spacing and flexible angle connectors, as needed, in order to facilitate a new angle or spacing. The manufacturer can then re-position and secure appropriately angled or dimensioned rigid angle connectors 50 to maintain the new configuration.

Figure 3:
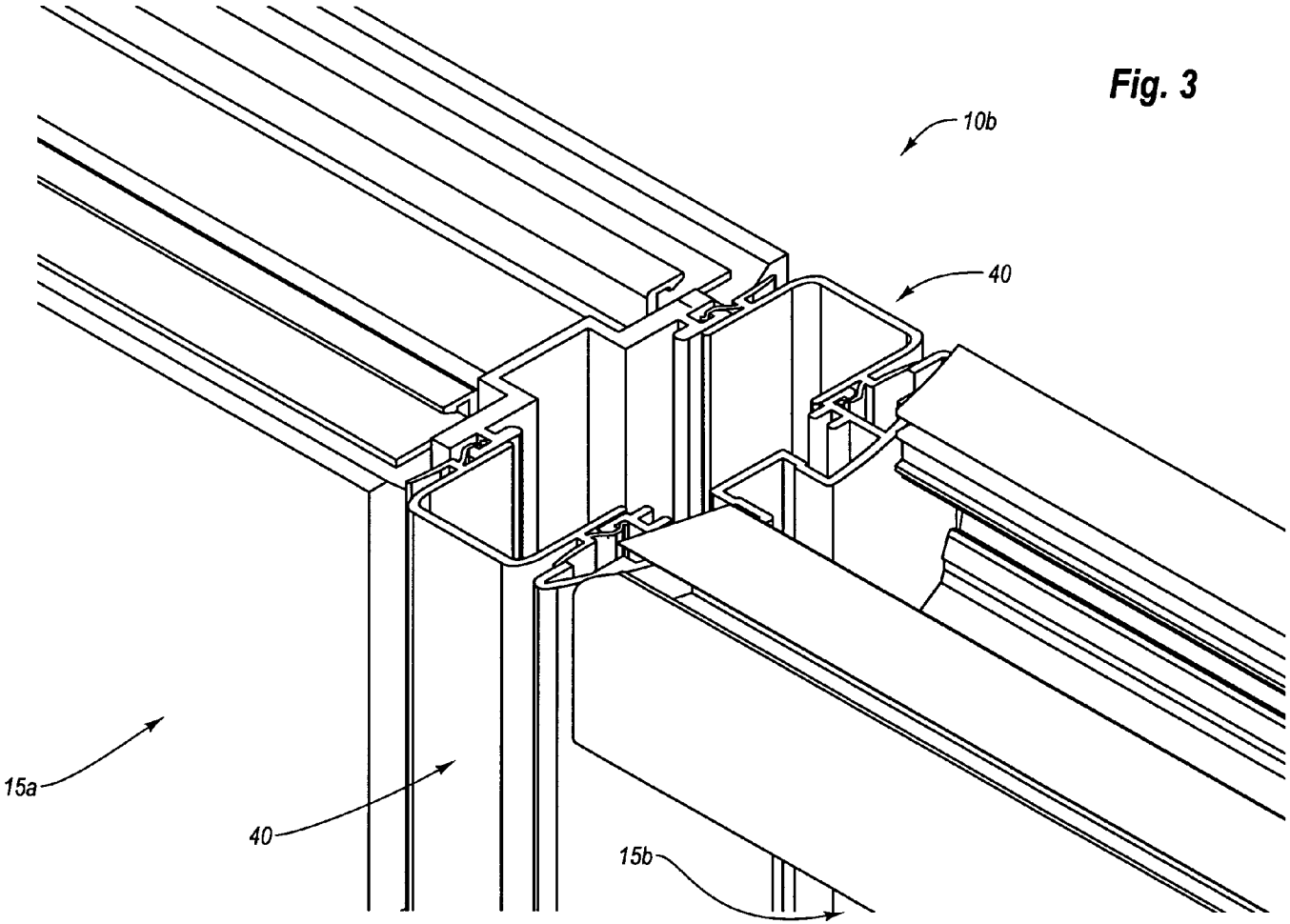
FIG. 3 illustrates an alternative joint between two wall modules that incorporates two flexible spacing connectors.

In addition to the foregoing, one will further appreciate that a manufacturer need not necessarily use only one flexible spacing connector 40 and one flexible angle connector 20 at each joint. In particular, there may be other reasons or needs to use two flexible angle connectors 20 at a particular joint (not shown), or two flexible spacing connectors 40 at a particular joint. For example, FIG. 3 illustrates a perspective view in which the two opposing wall modules of FIGS. 1A-2 are alternatively secured using two flexible spacing connectors. In this particular implementation, therefore, flexible joint means 10*b* comprises a plurality of flexible spacing connectors 40, rather than a combination of flexible spacing and flexible angle connectors.

Accordingly, at least one implementation of flexible joint means 10*b* comprises (i) two opposing wall modules 15*a-b*, (ii) at least two connector interfaces 5*a*, 5*b*, etc., and (iii) two flexible spacing connectors 40. In at least one implementation, the flexible joint means 10*b* further comprises (iv) any number of rigid angle connectors 50, and (v) corresponding upper connector interface plates 30*a*. Similarly, at least another implementation of flexible joint means can alternatively comprise (iii) at least two flexible angle connectors 20, rather than two flexible spacing connectors 40.

Of course, one will appreciate that still further variations of variable flexible joint means are possible in accordance with the present invention, and that a different flexible joint means can be implemented at each different wall module joint in a complex configuration. In general, the manufacturer will take a number of considerations into account when choosing flexible connectors for a given flexible joint means. In one implementation, for example, the manufacturer may use two flexible angle connectors 20 to minimize spacing and flexibility between two wall modules 15*a-b*, and to minimize potential angling between wall modules 15*a-b*. In another implementation, the manufacturer may use two flexible spacing connectors 40 to alternatively maximize spacing and flexibility between two wall modules 15*a-b*, but similarly minimize potential angling between wall modules 15*a-b*.

Accordingly, implementations of the present invention provide a great deal of flexibility in the design and layout of partitions for interior systems. This is at least in part since implementations of the present invention provide a great deal of flexibility with respect to angles and spacing between adjacent wall modules. One will appreciate that these and other such advantages can be realized without the otherwise time consuming and costly practice of producing project-specific components for each design solution.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. In an office environment in which a manufacturer or assembler positions a plurality of modular walls together to partition one or more spaces, a flexible joint means for stably joining modular walls at a plurality of arbitrary angles, comprising:

at least a first wall module and an opposed second wall module;

a connector interface attached to an edge of first wall module and an opposing connector interface attached to the opposed second wall module; and at least a first and second flexible connector, wherein each of the first and second flexible connectors reversibly attach to both of the opposed connector interfaces, wherein each flexible connector comprises:

a first wall and an opposing second wall;

a first gripping element;

a first flange connected to the first gripping element and hingedly connected to the first wall, wherein depression of the first flange causes the first gripping element to pivot away from the first wall to facilitate connecting the flexible connector to, and disconnecting the flexible connector from, the connector interface attached to the first wall module;

a second gripping element; and a second flange connected to the second gripping element and hingedly connected to the second wall, wherein depression of the second flange causes the second gripping element to pivot away from the second wall to facilitate connecting the flexible connector to, and disconnecting the flexible connector from, the connector interface attached to the second wall module;

wherein the first wall module and the opposed second wall module are movable with respect to each other about the first and second flexible connectors.

2. The flexible joint means as recited in claim 1, wherein the first and second flexible connectors comprise a flexible angle connector configured to provide a pivot point, and a flexible spacing connector configured to expand to accommodate rotation of the first wall with respect to the second wall about the pivot point.

3. The flexible joint means as recited in claim 2, wherein the flexible angle connector is configured with sufficient dimension to seal a joint between the two wall modules, and to facilitate a connection angle between the two wall modules of between 0° and 90°.

4. The flexible joint means as recited in claim 3, wherein the flexible angle connector is configured to facilitate a connection angle between the two wall modules of between 90° and 180°.

5. The flexible joint means as recited in claim 1, wherein the first and second flexible connectors comprise first and second flexible spacing connectors.

6. The flexible joint means as recited in claim 1, wherein the first and second flexible connectors comprise first and second flexible angle connectors.

7. The flexible joint means as recited in claim 1, further comprising:

at least one upper connector interface for connection to an upper surface of at least one of the first or second wall modules; and a rigid angle connector configured to insert within the upper connector interface and to hold both the first and second wall modules together at a desired angle.

8. In an interior or exterior space in which a manufacturer or assembler partitions the space with modular walls, a system for partitioning the interior or exterior space using modular walls with virtually any geometric layout, comprising:

a plurality of modular walls configured to be joined together as one or more partitions, the plurality of modular walls each having at least one edge to be joined with an edge of another of the plurality of modular walls; and a plurality of flexible joint means for flexibly joining the edges between the plurality of modular walls, wherein each of the flexible joint means is configured in size and shape to:

seal the edges between the plurality of modular walls to be joined; and orient at least two of the modular walls at substantially non-planar angles;

wherein the flexible joint means comprises a plurality of flexible connectors, each flexible connector comprising:

a first wall and an opposing second wall;

a first gripping element;

a first flange connected to the first gripping element and hingedly connected to the first wall, wherein depression of the first flange causes the first gripping element to pivot away from the first wall to facilitate connecting the flexible connector to, and disconnecting the flexible connector from, a first modular wall of the plurality of modular walls;

a second gripping element; and a second flange connected to the second gripping element and hingedly connected to the second wall, wherein depression of the second flange causes the second gripping element to pivot away from the second wall to facilitate connecting the flexible connector to, and disconnecting the flexible connector from, a second modular wall of the plurality of modular walls.

9. The system as recited in claim 8, wherein the plurality of flexible connectors comprise a plurality of gripping elements configured to slide along and grip rails of two opposing connector interfaces.

10. The system as recited in claim 8, wherein the plurality of flexible connectors comprise a u-shaped flexible spacing connector and a v-shaped flexible angle connector.

11. The system as recited in claim 10, wherein:

the flexible angle connector is configured so that the two wall modules are positioned toward an outside edge of the flexible angle connector; and the flexible spacing connector is configured so that the two wall modules simultaneously are positioned away from an outside edge of the flexible spacing connector.

12. The system as recited in claim 8, wherein the plurality of flexible connectors comprise a plurality of flexible spacing connectors at a single joint between two wall modules.

13. The system as recited in claim 8, wherein the plurality of flexible connectors comprise a plurality of flexible angle connectors at a single joint between two wall modules.

14. In an interior or exterior space in which a manufacturer or assembler partitions the interior or exterior space with modular walls, a method of partitioning the interior or exterior space with adjacent modular components at both planar and non-planar angles using flexible connectors, comprising:

arranging a plurality of wall modules in an interior or exterior space, wherein at least two of the plurality of wall modules are to be connected together at an angle;

connecting two connector interfaces of the two wall modules together on a first side with a first flexible connector, the first flexible connector including a first wall, an opposing second wall, a first gripping element, a first flange connected to the first gripping element of the first flexible connector and hingedly connected to the first wall of the first flexible connector, a second gripping element, a second flange connected to the second gripping element of the first flexible connector and hingedly connected to the second wall of the first flexible connector;

connecting the two connector interfaces of the two wall modules together on an opposing second side with a second flexible connector, the second flexible connector including a first wall, an opposing second wall, a first gripping element, a first flange connected to the first gripping element of the second flexible connector and hingedly connected to the first wall of the second flexible connector, a second gripping element, a second flange connected to the second gripping element of the second flexible connector and hingedly connected to the second wall of the second flexible connector; and positioning one of the two wall modules with respect to the other of the two wall modules so that the two wall modules form a non-planar angle.

15. The method recited in claim 14, further comprising positioning a rigid angle connector on an upper surface of the two wall modules, and securing the non-planar angle by securing the rigid angle connector to the upper surfaces.

16. The method recited in claim 14, wherein connecting the two connector interfaces of the two wall modules together on a first side with a first flexible connector further comprises:

depressing the first and second flanges of the first flexible connector, which causes the first gripping element of the first flexible connector to pivot away from the first wall of the first flexible connector and causes the second gripping element of the first flexible connector to pivot away from the second wall of the first flexible connector;

while the first and second flanges of the first flexible connector are depressed, positioning the first and second gripping elements of the first flexible connector proximate a first pair of opposing rails of the two connector interfaces; and releasing the first and second flanges of the first flexible connector, which causes the first and second gripping elements of the first flexible connector to grip the first pair of opposing rails of the two connector interfaces.

17. The method recited in claim 14, wherein connecting the two connector interfaces forms a seal along the edges of the two wall modules both before and after positioning the two wall modules to form an angle.

18. The method recited in claim 16, wherein connecting the two connector interfaces of the two wall modules together on an opposing second side with a second flexible connector further comprises:

depressing the first and second flanges of the second flexible connector, which causes the first gripping element of the second flexible connector to pivot away from the first wall of the second flexible connector and causes the second gripping element of the second flexible connector to pivot away from the second wall of the second flexible connector;

while the first and second flanges of the second flexible connector are depressed, positioning the first and second gripping elements of the second flexible connector proximate a second pair of opposing rails of the two connector interfaces; and releasing the first and second flanges of the second flexible connector, which causes the first and second gripping elements of the second flexible connector to grip the second pair of opposing rails of the two connector interfaces.

19. The method recited in claim 18, wherein the first flexible connector is a flexible angle connector; and wherein the second flexible connector is a flexible spacing connector.

* * * * *